US009448571B2

(12) United States Patent
Yu

(10) Patent No.: US 9,448,571 B2
(45) Date of Patent: Sep. 20, 2016

(54) VOLTAGE CONVERTING CIRCUIT HAVING VOLTAGE FEEDBACK TERMINAL

(71) Applicant: Fitipower Integrated Technology, Inc., Hsinchu (TW)

(72) Inventor: Shang-Cheng Yu, Hsinchu (TW)

(73) Assignee: Filipower Integrated Technology, Inc., Hsinchu (TW)

( * ) Notice: Subject to any disclaimer, the term of this patent is extended or adjusted under 35 U.S.C. 154(b) by 103 days.

(21) Appl. No.: 14/568,981

(22) Filed: Dec. 12, 2014

(65) Prior Publication Data

US 2016/0170422 A1 Jun. 16, 2016

(51) Int. Cl.
*G05F 1/10* (2006.01)

(52) U.S. Cl.
CPC ..... *G05F 1/10* (2013.01)

(58) Field of Classification Search
CPC ..... G05F 1/10
See application file for complete search history.

(56) References Cited

U.S. PATENT DOCUMENTS 5,691,627 A * 11/1997 Shum ..... G05F 1/10 323/222
7,834,607 B2 * 11/2010 Kojima ..... G11C 5/147 323/231
8,446,163 B2 * 5/2013 Kobatake ..... G01R 31/31706 324/523
2001/0002111 A1 * 5/2001 Isobe ..... G05F 1/10 327/323
2014/0253081 A1 * 9/2014 Duncan ..... G05F 1/10 323/284

* cited by examiner

*Primary Examiner* — Jue Zhang
(74) *Attorney, Agent, or Firm* — Zhigang Ma

(57) ABSTRACT

A voltage converting circuit includes an input terminal, an output terminal, a main circuit a feedback terminal, a testing unit, and a detection unit. The main circuit is coupled between the input terminal and the output terminal to convert a first voltage input from the input terminal into a second voltage and output the second voltage via the output terminal. The feedback terminal is coupled to the output terminal and the testing unit is coupled to the feedback terminal to output a testing current to the feedback terminal to change a third voltage of the feedback terminal. The detection unit is coupled between the feedback terminal and the main circuit. The detection unit detects a change to the third voltage feedback from the feedback terminal to enable or disable the main circuit according to the change to the third voltage.

13 Claims, 6 Drawing Sheets

VOLTAGE CONVERTING CIRCUIT HAVING VOLTAGE FEEDBACK TERMINAL

FIELD

The subject matter herein generally relates to a voltage converting circuit.

BACKGROUND

Voltage converting circuits are widely used in various electronic devices, such as mobile phones, tablet computers, personal computers, media players, or other devices of the like. The voltage converting circuits convert a first voltage into a second voltage. Generally, a feedback terminal can be incorporated into the voltage converting circuit to feedback a voltage signal of the second voltage to a control unit, to make the voltage converting circuit output a steady voltage.

BRIEF DESCRIPTION OF THE DRAWINGS

Implementations of the present technology will now be described, by way of example only, with reference to the attached figures.

DETAILED DESCRIPTION

Figure 1:
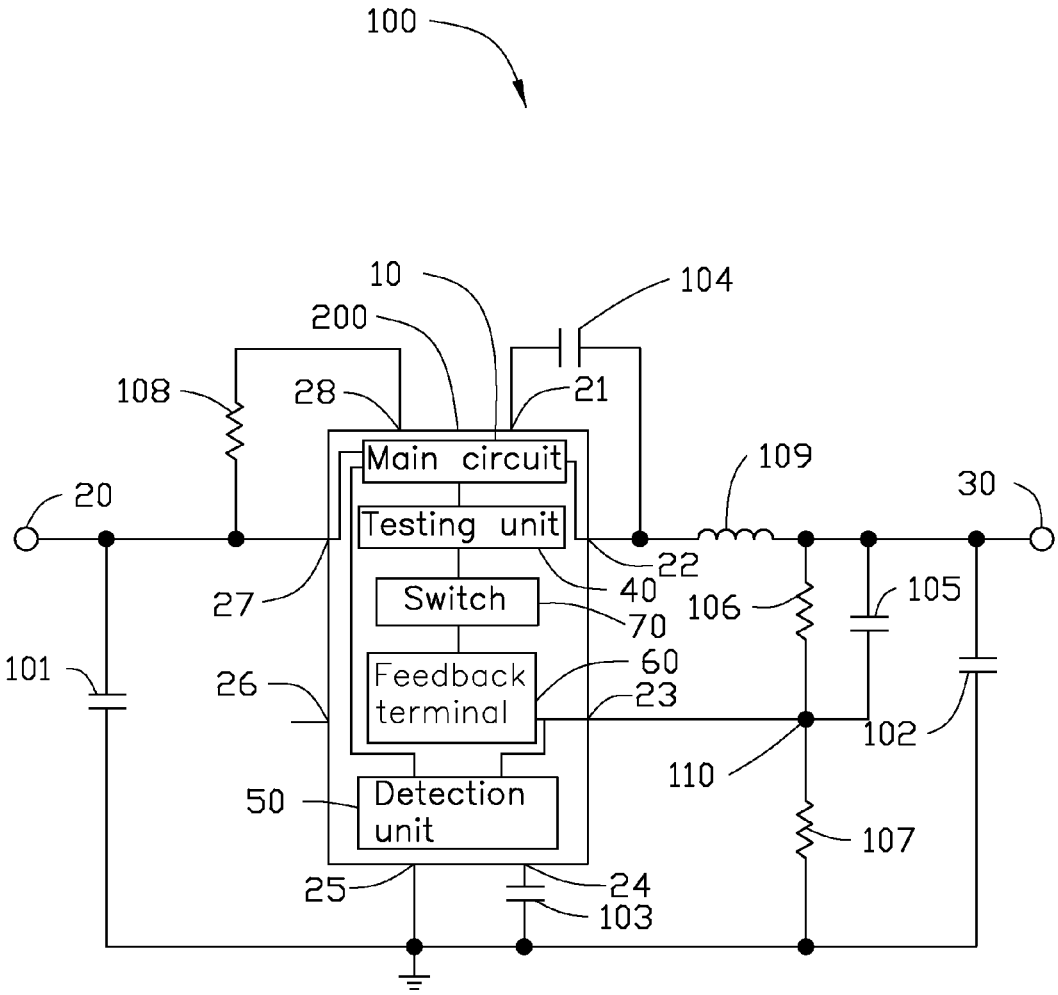
FIG. 1 is a circuit diagram of a voltage converting circuit according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "coupled" is defined as connected, whether directly or indirectly through intervening components, and is not necessarily limited to physical connections. The connection can be such that the objects are permanently connected or releasably connected.

The present disclosure is described in relation to a voltage converting circuit.

FIG. 1 illustrates a circuit diagram of a voltage converting circuit 100. The voltage converting circuit 10 includes a main circuit 10, an input terminal 20, an output terminal 30, a testing unit 40, a detection unit 50, and a feedback terminal 60. The main circuit 10 is coupled between the input terminal 20 and the output terminal 30. The main circuit 10 can convert a first voltage V1 from the input terminal 20 into a second voltage V2, and output the second voltage V2 via the output terminal 30. The feedback terminal 60 is coupled to the output terminal 30 and the detection unit 50 to feedback a third voltage V3 to the detection unit 50. The detection unit 50 is coupled between the main circuit 10 and the feedback terminal 60, to detect a change to feedback of the third voltage V3 from the feedback terminal 60. The detection unit 50 sends a detection result indicating the change to the third voltage V3 to the main circuit 10, to turn on or turn off the main circuit 10. In at least one embodiment, a voltage value of the first voltage V1 is in a range form about 4.5V to about 18V, and a voltage value of the second voltage V2 is about 1.2V.

In addition, the voltage converting circuit 100 can further include a switch unit 70 coupled between the testing unit 40 and the feedback terminal 60 to make or break an electric connection therebetween. When the testing unit 40 is coupled to the feedback terminal 60 via the switch unit 70, the testing unit 40 outputs a test current I to the feedback terminal 60. In at least one embodiment, the main circuit 10, the testing unit 40, the detection unit 50, the feedback terminal 60, and the switch 70 can be integrated in a voltage converting chip 200. The voltage converting chip 200 includes a power input pin 27, a power output pin 22, and a feedback pin 23. The power input pin 27 is coupled to the input terminal 20 to receive the first voltage V1. The power output pin 22 is coupled to the output terminal 30 via an inductor 109 to output the second voltage V2 to the output terminal 30. The feedback pin 23 is coupled between the feedback terminal 60 and the output terminal 30.

The voltage converting chip 200 can further include an enable pin 28, a boost pin 21, a delay pin 24, a ground pin 25 and a floating pin 26. The enable pin 28 is coupled to the input terminal 20 via a resistor 108 to enable or disable the voltage converting chip 200. The boost pin 21 is coupled to a node between the output pin 22 and the inductor 109 via a capacitor 104. The delay pin 24 is grounded via a capacitor 103, and the ground pin 25 is grounded. In at least one embodiment, a resistance of the resistor 108 is about 100 KΩ, and a capacitance of the capacitor 104 is about 0.1 μF.

A first filtering capacitor 101 is coupled between the input terminal 20 and a ground. A second filtering capacitor 102 is coupled between the output terminal 30 and the ground. One end of the inductor 109 is coupled to the output pin 22 and the other end of the inductor is grounded via a first dividing resistor 106 and a second dividing resistor 108 connected to the first dividing resistor 106 in series. The feedback pin 23 is coupled to a node 110 between the first dividing resistor 106 and the second dividing resistor 107 to feedback the third voltage V3 to the detection unit 50. A third filtering capacitor 105 is coupled between the feedback pin 23 and the output terminal 30. In at least one embodiment, each of the first filtering capacitor 101, the second filtering capacitor 102, and the third filtering capacitor 103 are configured to filter noises, such as ripple waves. A capacitance of the first capacitor 101 can be 22 μF, a capacitance of the second capacitor 102 can be 47 μF. A resistance of the first dividing resistor 106 can be 4.99 KΩ, and a resistance of the second dividing resistor can be 10 KΩ.

In at least one embodiment, the testing unit 40 outputs the testing current I to the feedback terminal 60 in a first time interval T1, and stops outputting the testing current I to the feedback terminal 60 in a second time interval T2 following the first time interval T1. The detection unit 50 detects the change to the third voltage V3 feedback from the feedback terminal 60 within the first time interval T1 and the second time interval T2. If the third voltage V3 is greater than a reference voltage $V_{ref}$ within the first time interval T1 and is less than the reference voltage $V_{ref}$ within the second time interval T2, the detection unit 50 sends an enable signal to enable the main circuit 10 to convert the first voltage V1 into the second voltage V2. Otherwise, if the third voltage V3 is not greater than the reference voltage $V_{ref}$ within the first time interval T1 or is not less than the reference voltage $V_{ref}$ within the second time interval T2, the detection unit 50 sends a disable signal to disable the main circuit 10. In the embodiment, the reference voltage $V_{ref}$ is greater than the second voltage V2. For example, a voltage value of the reference voltage $V_{ref}$ can be 1.5V. The testing current I can be 1 mA.

Figure 2:
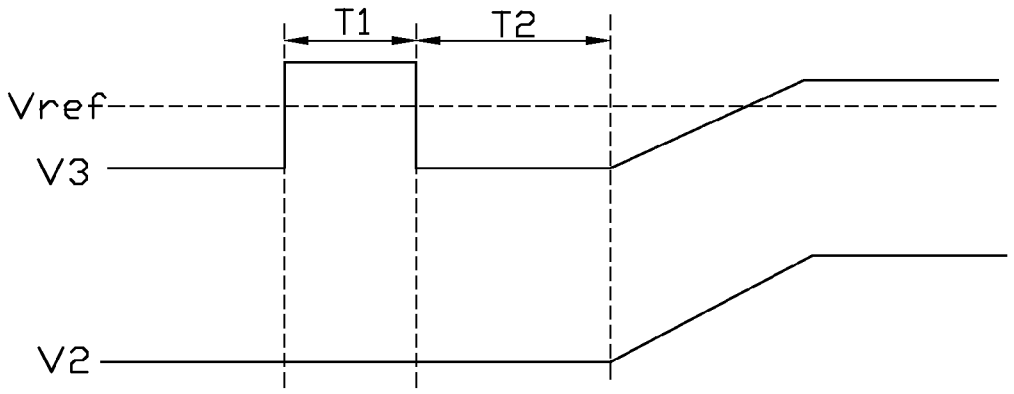
FIG. 2 is a diagram illustrating a change to a third voltage feedback from a feedback terminal of FIG. 1 upon the condition that the feedback terminal is working normally.

FIG. 2 is a diagram illustrating a change to the third voltage V3 upon the condition that the feedback terminal 60 is working normally. In the first time interval T1, the switch 70 is turned on to make the electric connection between the testing unit 40 and the feedback terminal 60. The testing unit 40 outputs the testing current I to the feedback terminal 60. At this time, the third voltage V3 feedback from the feedback terminal 60 increases and the detection unit 50 will detect that the third voltage V3 is greater than the reference voltage $V_{ref}$. Then, in the following second time interval T2, the switch 70 is turned off to break the electric connection between the testing unit 40 and the feedback terminal 60 and the testing unit 40 stops outputting the testing current I to the feedback terminal 60. At this time, the third voltage V3 feedback from the feedback terminal 60 gradually decreases, and the detection unit 50 will detect that the third voltage V3 is less than the reference voltage $V_{ref}$. Finally, the change to the third voltage V3 within the first time interval T1 and the second time interval T2 indicates that the feedback terminal 60 is working normally. Therefore, the detection unit 50 will send the enable signal to enable the main circuit to convert the first voltage V1 into the second voltage V2.

Figure 3:
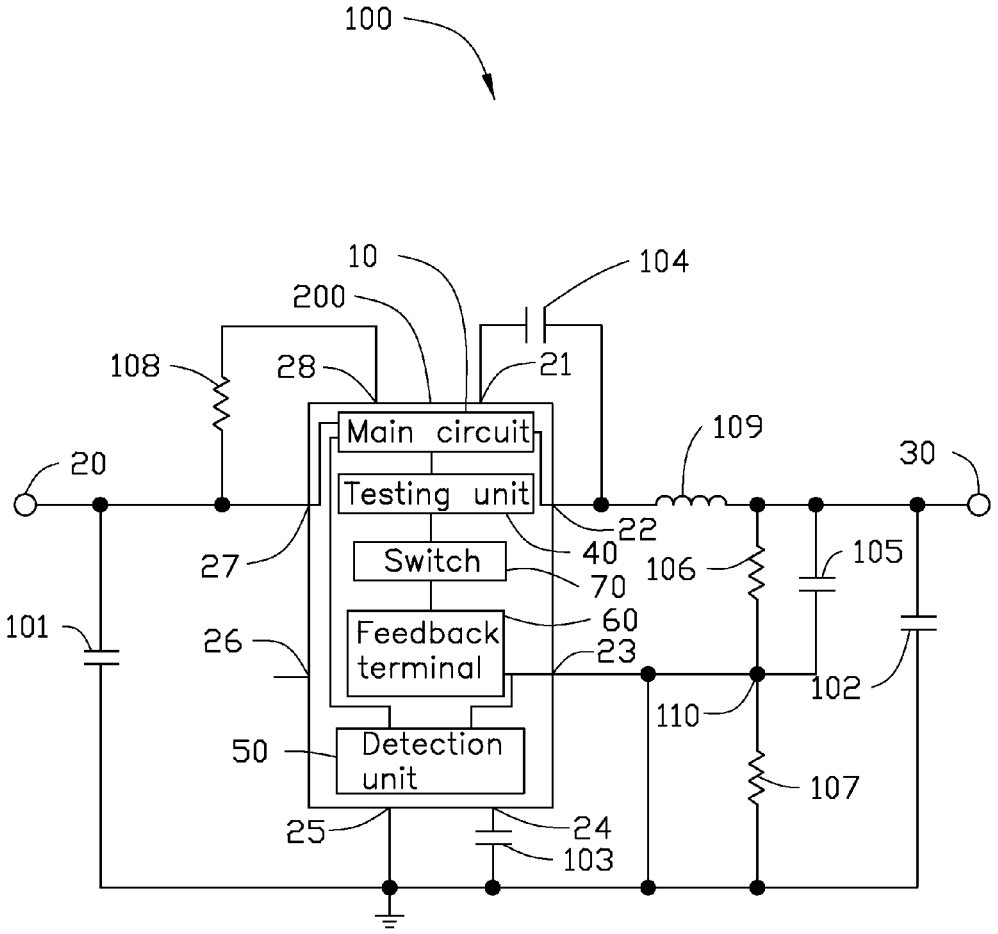
FIG. 3 shows the feedback terminal in a first malfunction state.
Figure 4:
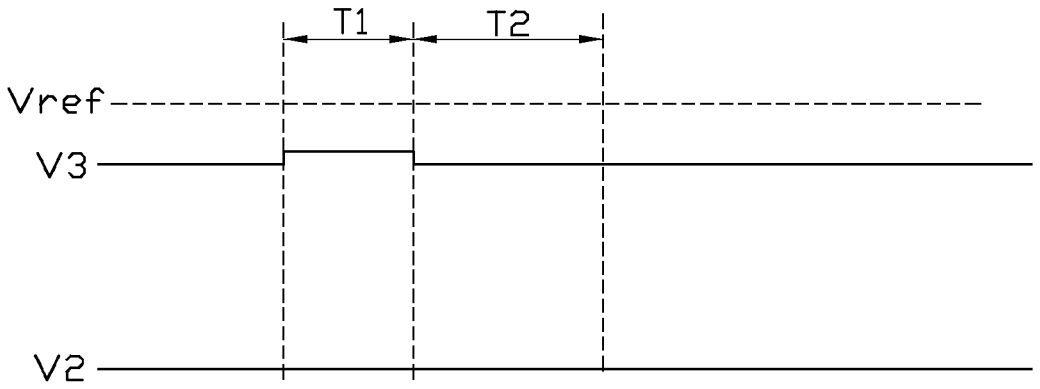
FIG. 4 is a diagram illustrating a change to the third voltage when the feedback terminal is in the first malfunction state.

FIG. 3 illustrates the feedback terminal 60 in a first malfunction state, FIG. 4 is a diagram illustrating a change to the third voltage V3 when the feedback terminal 60 is in the first malfunction state. In the first malfunction state, the feedback terminal 60 is grounded. Under this condition, when the testing unit 40 outputs the testing current I to the feedback terminal 60 in the first time interval T1, the third voltage V3 feedback from the feedback terminal 60 cannot increase because the feedback terminal is grounded. Thus, the detection unit 50 will detect that the third voltage V3 is not greater than the reference voltage $V_{ref}$. Therefore, the detection unit 50 will send the disable signal to disable the main circuit 10 due to the feedback terminal 60 is in the first malfunction state.

Figure 5:
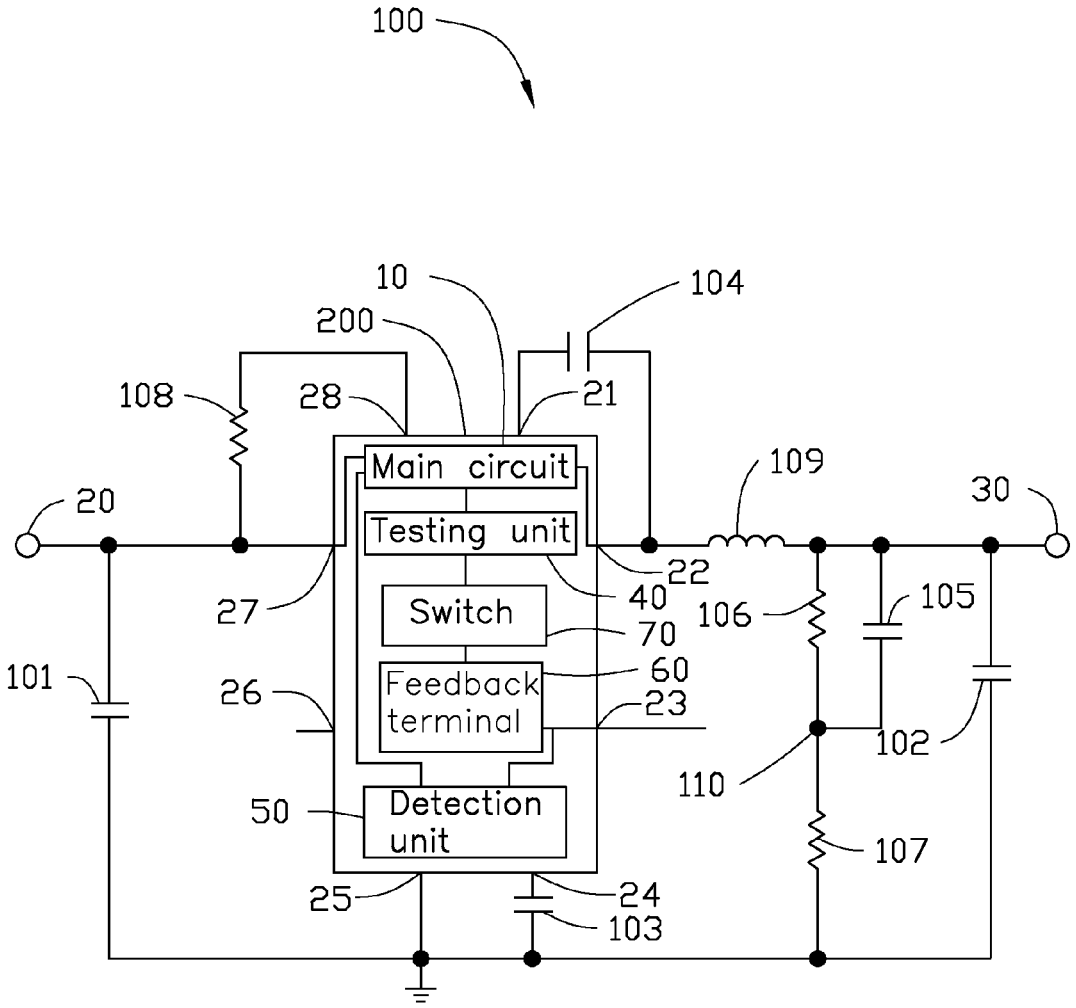
FIG. 5 shows the feedback terminal in a second malfunction state.
Figure 6:
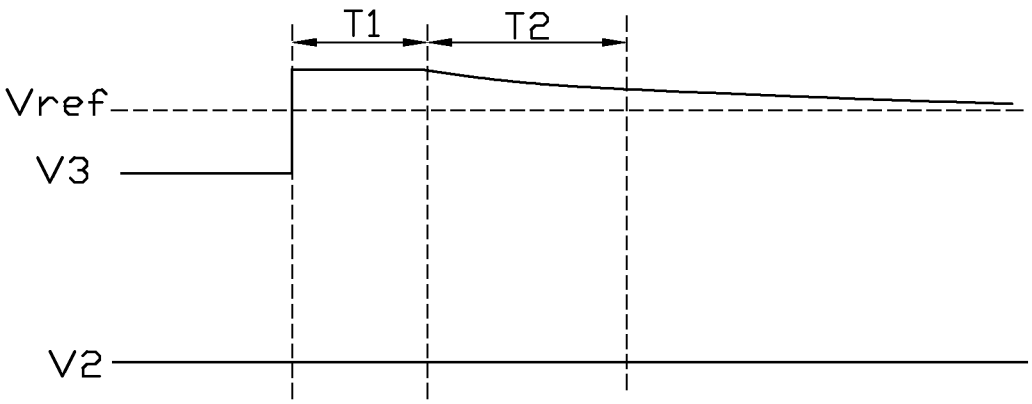
FIG. 6 is a diagram illustrating a change to the third voltage when the feedback terminal is in the second malfunction state.

FIG. 5 shows the feedback terminal 60 in a second malfunction state, and FIG. 6 is a diagram illustrating a change to the third voltage V3 when the feedback terminal 60 is in the second malfunction state. In the second malfunction state, the electric connection between feedback terminal 60 and the node 110 is disconnected. Under this condition, when the testing unit 40 outputs the testing current I to the feedback terminal 60 in the first time interval T1, the third voltage V3 feedback from the feedback terminal 60 gradually increases, and the detection unit 50 will detect that the third voltage V3 is greater than the reference voltage $V_{ref}$. Then, in the following second time interval T2, the switch 70 is turned off to break the electric connection between the testing unit 40 and the feedback terminal 60 and the testing unit 40 stops outputting the testing current I to the feedback terminal 60. At this time, the third voltage V3 feedback from the feedback terminal 60 cannot decrease, and the detection unit 50 will detect that the third voltage V3 is still greater than the reference voltage $V_{ref}$. Thus, the change to the third voltage V3 within the first time interval T1 and the second time interval T2 indicates that the feedback terminal 60 does not work normally. Therefore, the detection unit 50 will send the disable signal to disable the main circuit 10.

As discussed above, when the feedback terminal 60 is in the malfunction state, the main circuit 10 can be disabled to protect the main circuit 10. Therefore, the stability of the voltage converting circuit 100 is improved.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A voltage converting circuit comprising:

an input terminal;

an output terminal;

a main circuit coupled between the input terminal and the output terminal, the main circuit configured to convert a first voltage input from the input terminal into a second voltage and output the second voltage via the output terminal;

a feedback terminal coupled to the output terminal;

a testing unit coupled to the feedback terminal and configured to output a testing current to the feedback terminal to change a third voltage of the feedback terminal; and a detection unit coupled between the feedback terminal and the main circuit and configured to detect a change to the third voltage feedback from the feedback terminal and to enable or disable the main circuit in accordance with the change to the third voltage.

2. The voltage converting circuit according to claim 1, wherein a switch is coupled between the testing unit and the feedback terminal to make or break an electric connection between the testing unit and the feedback terminal.

3. The voltage converting circuit according to claim 2, wherein the testing unit outputs the testing current to the feedback terminal in a first time interval, and stops outputting the testing current to the feedback terminal in a second time interval following the first time interval.

4. The voltage converting circuit according to claim 3, wherein the switch is turned on to make the electric connection between the testing unit and the feedback terminal in the first time interval and is turned off to break the electric connection the testing unit and the feedback terminal in the second time interval.

5. The voltage converting circuit according to claim 2, wherein when the third voltage is greater than a reference voltage within the first time interval and is less than the reference voltage within the second time interval, the detection unit sends an enable signal to enable the main circuit to convert the first voltage into the second voltage.

6. The voltage converting circuit according to claim 5, wherein the reference voltage is greater than the second voltage.

7. The voltage converting circuit according to claim 2, wherein when the third voltage is not greater than the reference voltage within the first time interval or is not less than the reference voltage within the second time interval, the detection unit sends a disable signal to disable the main circuit.

8. The voltage converting circuit according to claim 7, wherein the reference voltage is greater than the second voltage.

9. The voltage converting circuit according to claim 1, wherein the main circuit, the testing unit, the feedback terminal, and the detection unit are integrated in a voltage converting chip; the voltage converting chip comprises a power input pin configured to receive the first voltage from the input terminal and a power output pin configured to output the second voltage to the output terminal.

10. The voltage converting circuit according to claim 9, wherein the power input pin is coupled to the input terminal to receive the first voltage and the power output pin is coupled to the output terminal via an inductor.

11. The voltage converting circuit according to claim 1, wherein the testing current is about 1 mA.

12. The voltage converting circuit according to claim 1, wherein a voltage of the first voltage is in a range from about 4.5V to about 18V.

13. The voltage converting circuit according to claim 1, wherein a voltage of the second voltage is about 1.2V and a voltage of the reference voltage is about 1.5V.

* * * * *